US008674672B1

(12) United States Patent
Johal et al.

(10) Patent No.: US 8,674,672 B1
(45) Date of Patent: Mar. 18, 2014

(54) REPLICA NODE FEEDBACK CIRCUIT FOR REGULATED POWER SUPPLY

(75) Inventors: Jaskarn Johal, Mukilteo, WA (US); Erhan Hancioglu, Bothell, WA (US)

(73) Assignee: Cypress Semiconductor Corporation, San Jose, CA (US)

( * ) Notice: Subject to any disclaimer, the term of this patent is extended or adjusted under 35 U.S.C. 154(b) by 116 days.

(21) Appl. No.: 13/340,990

(22) Filed: Dec. 30, 2011

(51) Int. Cl.
*G05F 1/565* (2006.01)
*G05F 1/575* (2006.01)

(52) U.S. Cl.
USPC ..... 323/275; 323/280

(58) Field of Classification Search
USPC ..... 323/273–281, 282
See application file for complete search history.

(56) References Cited

U.S. PATENT DOCUMENTS

| | | | | |
|---|---|---|---|---|
| 5,066,901 | A * | 11/1991 | Cheah et al. | 323/267 |
| 5,666,044 | A * | 9/1997 | Tuozzolo | 323/277 |
| 6,188,211 | B1 * | 2/2001 | Rincon-Mora et al. | 323/280 |
| 6,525,515 | B1 * | 2/2003 | Ngo et al. | 323/277 |
| 6,700,361 | B2 * | 3/2004 | Gregorius | 323/282 |
| 7,262,586 | B1 * | 8/2007 | Gradinariu | 323/280 |
| 7,285,940 | B2 * | 10/2007 | Kerth et al. | 323/226 |
| 7,710,776 | B2 * | 5/2010 | Johal et al. | 365/185.08 |
| 8,169,203 | B1 * | 5/2012 | Vemula | 323/273 |

* cited by examiner

*Primary Examiner* — Adolf Berhane
*Assistant Examiner* — Nusrat Quddus

(57) ABSTRACT

A power supply includes a source signal generating circuit, an output stage, and a feedback stage. The power supply further includes a replica stage configured to replicate a response of the output stage to the source signal, and an output regulator coupling the replica stage to the output stage, configured to adjust a feedback signal to the source signal generating circuit by shunting the feedback stage when a loaded output stage response does not match a response of the replica stage to the source signal.

10 Claims, 6 Drawing Sheets

REPLICA NODE FEEDBACK CIRCUIT FOR REGULATED POWER SUPPLY

BACKGROUND

Power regulator designs may compromise performance because high precision or high performance circuit blocks cannot be used, due to load current demands. This is particularly true for low and very low power regulators.

Regulators are often challenged to supply a load that has a wide current range, for example 1 nA to 100 uA. FIG. 1 illustrates output voltage degradation for a conventional low power regulator as the load current is increased (linearly) from 0 nA to 1 mA.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

Preliminaries

Figure 1:
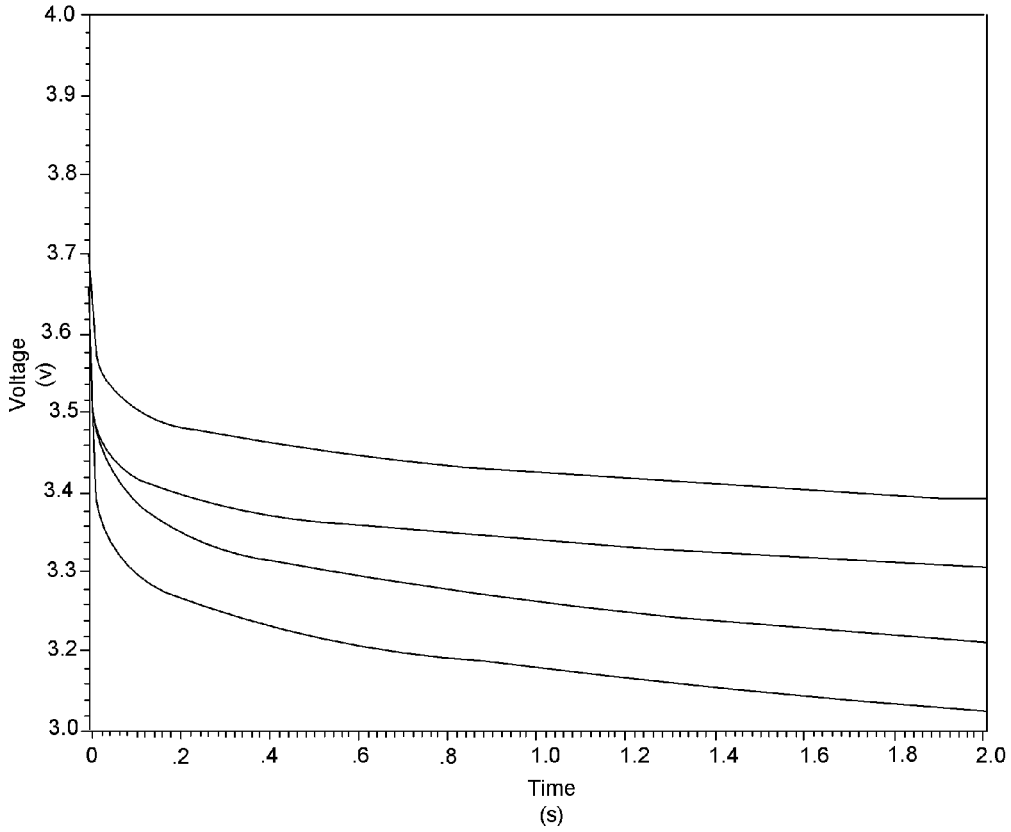
FIG. 1 (PRIOR ART)
FIG. 1 illustrates output voltage curves for some conventional low power regulators as the load current increases (linearly) from 0 nA to 1 mA.

References to "one embodiment" or "an embodiment" do not necessarily refer to the same embodiment, although they may. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively, unless expressly limited to a single one or multiple ones. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list, unless expressly limited to one or the other.

"Logic" refers to machine memory circuits, machine readable media, and/or circuitry which by way of its material and/or material-energy configuration comprises control and/or procedural signals, and/or settings and values (such as resistance, impedance, capacitance, inductance, current/voltage ratings, etc.), that may be applied to influence the operation of a device. Magnetic media, electronic circuits, electrical and optical memory (both volatile and nonvolatile), and firmware are examples of logic.

Those skilled in the art will appreciate that logic may be distributed throughout one or more devices, and/or may be comprised of combinations memory, media, processing circuits and controllers, other circuits, and so on. Therefore, in the interest of clarity and correctness logic may not always be distinctly illustrated in drawings of devices and systems, although it is inherently present therein.

The techniques and procedures described herein may be implemented via logic distributed in one or more computing devices. The particular distribution and choice of logic is a design decision that will vary according to implementation.

The term "grounded" refers to a connection to an electrical terminal that may be treated as "common" or "0V" for analytical purposes, but which may or may not in fact not be at earth ground (i.e., a "local ground" or "reference ground").

The term "shunt" refers to a connection between two circuit points. A shunt may be made through one or more circuit components. In this description, a shunt is more particularly a configurable connection between two circuit points, which can be controllably opened (signaling connectivity removed) or closed (signaling connectivity activated) under different conditions.

The terms "current regulated", "regulated current source", "current sink", or "constant current source" refer to logic to maintain a substantially constant amount of current to a load over a range of load impedances. In a non-regulated (non-constant) current source, the supplied current varies linearly with a change in the load resistance according to I=V/R, where V is the applied voltage. This is not the case for a regulated current source, in which I does not substantially over a range of different R for a particular V. The "load" is whatever logic is coupled across or between the terminals of the current regulated logic.

Overview

A plurality of FETs form an output regulator circuit for a power supply. The regulator comprises at least a pair of FETs sharing a common gate terminal. Typically, though not exclusively, the power supply utilizing the regulator is a low or ultra-low supply configured to supply a range of current to an attached load, without substantial (e.g., with less than 10% variation, and often less than 5% variation) drop in an output voltage to the load over the current range. At least two of FETs of the current regulator are coupled to one or more current sinks. A current sink is a circuit that maintains a constant amount of current flow through the circuit, despite increases or decreases in a voltage applied across the current sink circuit. One of the FETs drives a transistor (e.g., another FET), which modifies a feedback signal to a high impedance source that drives an output stage of the power supply. The high impedance source may comprise an OTA (operational transconductance amplifier) supplying a signal (the "source signal") that drives a source follower circuit in the output stage of the power supply.

Detailed Description of Particular Embodiments

Figure 2:
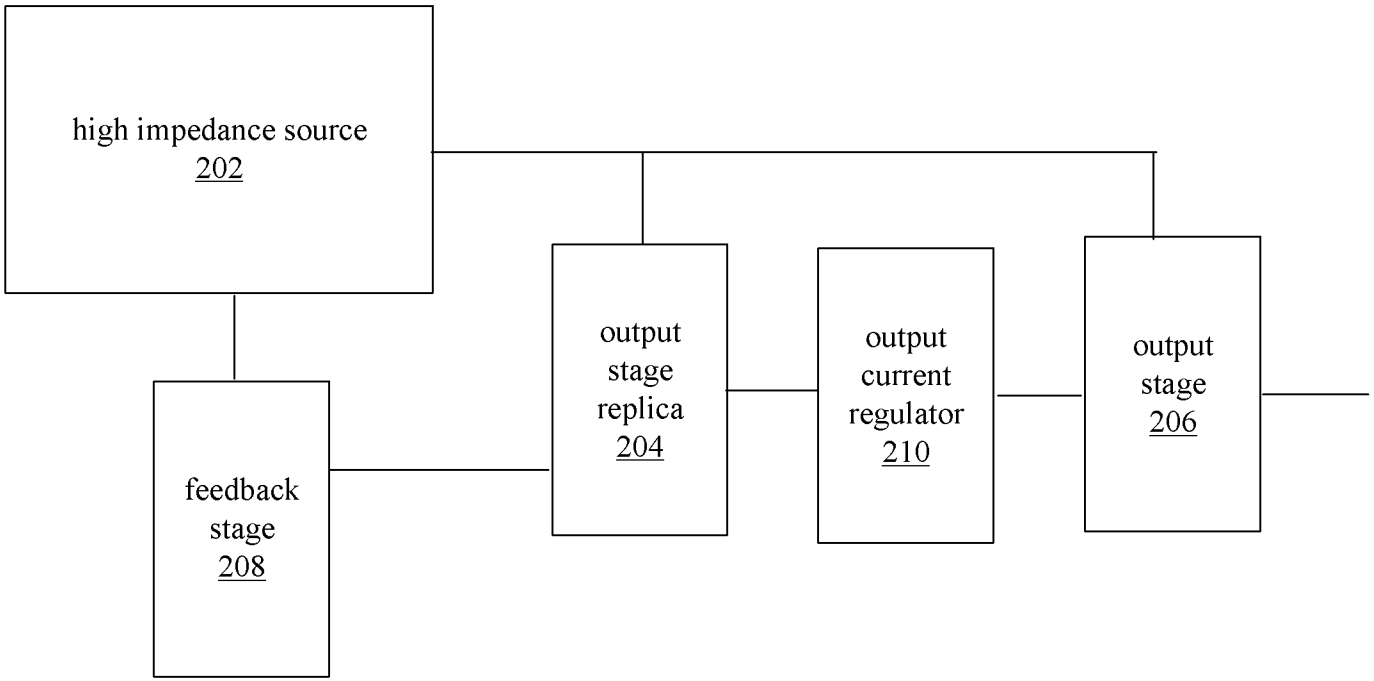
FIG. 2 is a block diagram illustration of a power supply regulator employing an output current regulator.

FIG. 2 is a block diagram illustration of a power supply employing an output current regulator. The power supply comprises a high impedance signal source 202, which may be a voltage source or a current source. As known in the art, a voltage source is a circuit that produces a substantially constant output voltage irrespective of the load impedance, over a range of loads. The signal source 202 may alternatively be a current source, such as an OTA. As known in the art, a current source provides a substantially constant output current, irrespective of the load impedance, over a range of loads.

The output of the high impedance source 202 is provided to a replica stage 204, and, in parallel, to an output stage 206. The replica stage replicates the manufactured characteristics of the output stage 206, and thus, when the output stage is not heavily loaded, mirrors the response of the output stage 206 to the signal (the "source signal") from the high impedance source 202. At the same time, the replica stage 204 isolates the feedback stage 208 from the output stage 206. A scaled response of the replica stage to the source signal is provided through the feedback stage 208 to an input of the high impedance source 202.

A current regulator 210 is coupled between the output stage 206 and the replica stage 204. The current regulator 210 controls the signal supplied through the feedback stage 208, to maintain the voltage at the output stage 206 relatively constant over a range of currents that may be demanded by the attached load. The current regulator 210 may be used with power supplies designed to operate at low currents, on the order of nanoamperes (nA). The regulator 210 provides load sensing and load voltage regulation while adding only a few nA to the overall power supply operating current under loaded conditions. The current regulator 210 is also generally applicable to higher current power supplies.

Figure 3:
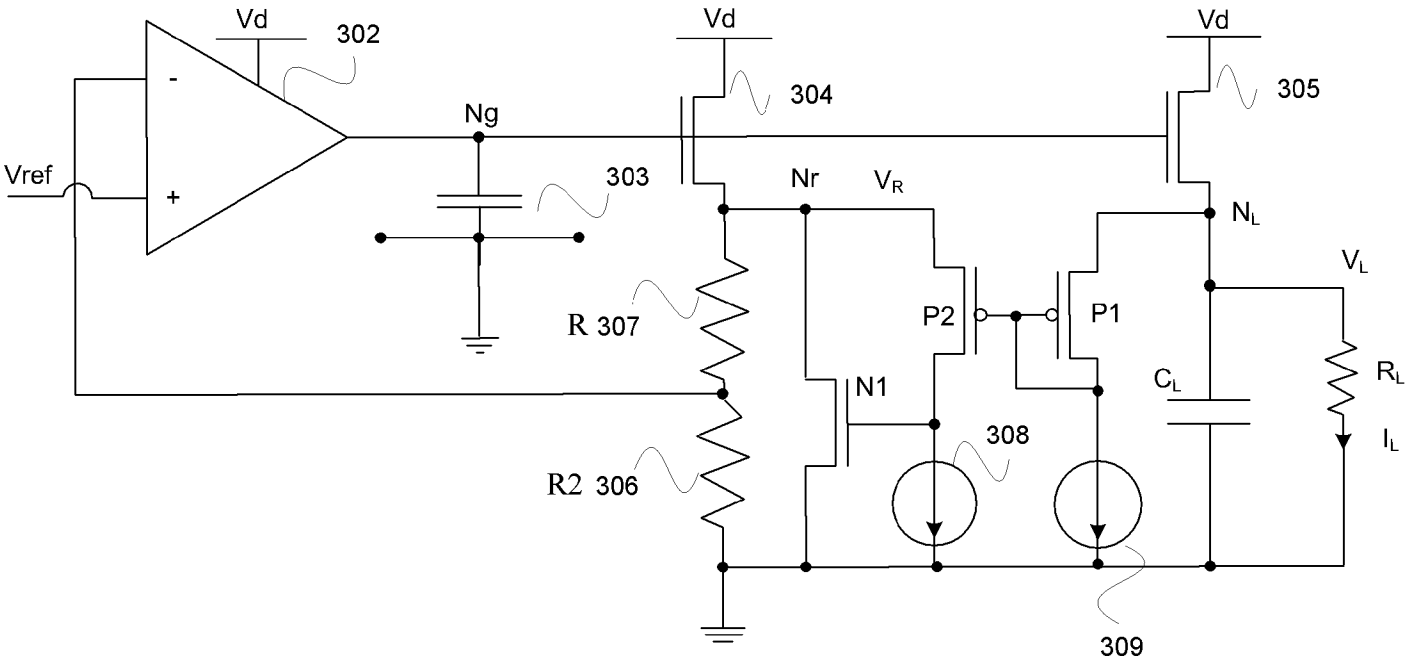
FIG. 3 illustrates an embodiment of the power supply regulator of FIG. 2 in more detail.

FIG. 3 illustrates an embodiment of the power supply of FIG. 2 in more detail. The high impedance source may comprise an operational amplifier 302. The op amp 302 inputs a reference signal and a feedback signal. If the operational amplifier 302 is an OTA, it may provide an output current (source signal) to node $N_G$. The op amp 302 or similar circuit is thus referred to as a source signal generator for the power supply. The source signal is proportional to the difference between the reference signal and the feedback signal. The compensation capacitor 303 provides voltage regulator stability. The source signal is supplied to the gates of two or more FETs 304, 305 (e.g., nFETs/pFETs/MOSFETs).

The replica stage of the power supply comprises a transistor 304 which is fabricated with similar characteristics as the output stage transistor 305. For example, transistor 304 may have a similar channel width/length ratio as transistor 305. Both of transistors 304 and 305 are configured as source followers of the source signal. Each is provided a common supply voltage $V_D$, thus the voltage at replica node $N_R$ substantially tracks (replicates) the output stage voltage at node $N_L$. The replica stage response is the voltage/current behavior of the replica stage in response to the source signal.

The feedback stage comprises a voltage divider 306, 307 coupled to the replica node $N_R$ and coupled to the negative terminal of the differential amplifier 302. Negative feedback of a portion of the replica voltage $V_R$ is therefore provided to the negative input of the differential amplifier 302. The feedback proportion of $V_R$ is R/(R+R2).

The output stage comprises output transistor 305. An attached load may be represented as a current $I_L$, an impedance $R_L$, and a capacitance $C_L$. The capacitance $C_L$ affects the stability of the power supply when coupled to the load. The current $I_L$ is indicative of the load demand. The voltage/current behavior of the output stage in response to the source signal, under the influence of the load $R_L$ and $C_L$, is referred to as the loaded output stage response.

The current regulator stage comprises transistors P1, P2, and N1, and current sinks 308, 309. The components P1 and P2 are preferably PFETs but may also be any device or devices that copy (i.e., convey) current proportional to the voltage $V_L$ to control transistor N1. Transistor P2 drives transistor N1, and by doing so alters the negative feedback signal level to differential amplifier 302. The current sinks 308 and 309 maintain a substantially constant (in a typical low-power regulator, on the order of nanoamperes) current on the gates of P1, P2 and N1. For applications where a larger amount of current is present at the regulated output, the current sinks 308 and 309 may provide more current (on the order of couple microamperes to 100s of microamperes) to speed up the control loop.

Transistor N1 shunts the feedback stage to ground, meaning forms a parallel, alternate path for current supplied to the feedback stage (thus influencing the voltage fed back to the op amp 302).

When $V_L>V_R$, the gate-to-source voltage of P2 is lower than its threshold voltage, and P2 is OFF (it conducts no current). Thus, the feedback voltage is $V_R$*R/(R+R2). A sufficient increase in $I_L$ will cause a drop in $V_L$. If the load current is high enough, $V_L$ will fall below $V_R$. The gate-to-source voltage of P2 becomes greater than the P2 threshold voltage, and P2 turns on and conducts an amount of current determined by current sinks 308 and 309. P1 is diode connected; therefore its gate voltage follows $V_L$. When $V_L$ decreases, the gate voltage of P1 decreases and P2 is affected (because both transistors P1 and P2 share the same gate voltage). The current sinks 308, 309 are always active regardless of the level of $V_L$. Current sink 308 turns off N1 by pulling its gate down. When the $V_L<V_R$, the gate voltage comes down causing P2 to have enough Vgs overdrive. Therefore, P1 is at that point copying to P2 the current present on 309. When the current copied to P2 is greater than the current on 308, the gate voltage of N1 starts to rise hence turning on N1. The N1 device is biased to be in saturation. The amount of saturation will vary depending on the application and other circuit conditions (such as how much $V_L$ dropped below $V_R$), pulling down $V_R$, causing the op amp 302 to adjust the source signal to bring up $V_L$. The loop gain of the feedback circuit is always less than one (1). The ratio of P1:P2 is set by their channel width (it is preferred to adjust the ratio of a current mirror via channel width, a ratio of length and/or width may be selected). The ratio of P1:P2 may be 1:1, but the ratio of current sinks 308 and 309 may be different, or both a ratio for P1:P2 and the current sinks may be optimally selected for the application. The amount of current through current sources 308, 309 determines the specific conditions under which N1 is turned on.

The dominant pole in the power supply is formed by the output impedance of the op amp 302 and the capacitance at Ng. The capacitance at Ng is primarily determined by the gate capacitances of transistors 304, 305 and by any compensation capacitor ($C_L$) in the regulated power supply. The regulated power supply becomes unstable when the pole formed by the load impedance $R_L$ and capacitance $C_L$ move close to the dominant pole. This condition reduces the phase margin in situations where the load capacitance $C_L$ is large enough, or load current $I_L$ is small enough. Instability is prevented by maintaining N1 OFF when the output pole ($C_L$*$R_L$) approaches the dominant pole.

Figure 4:
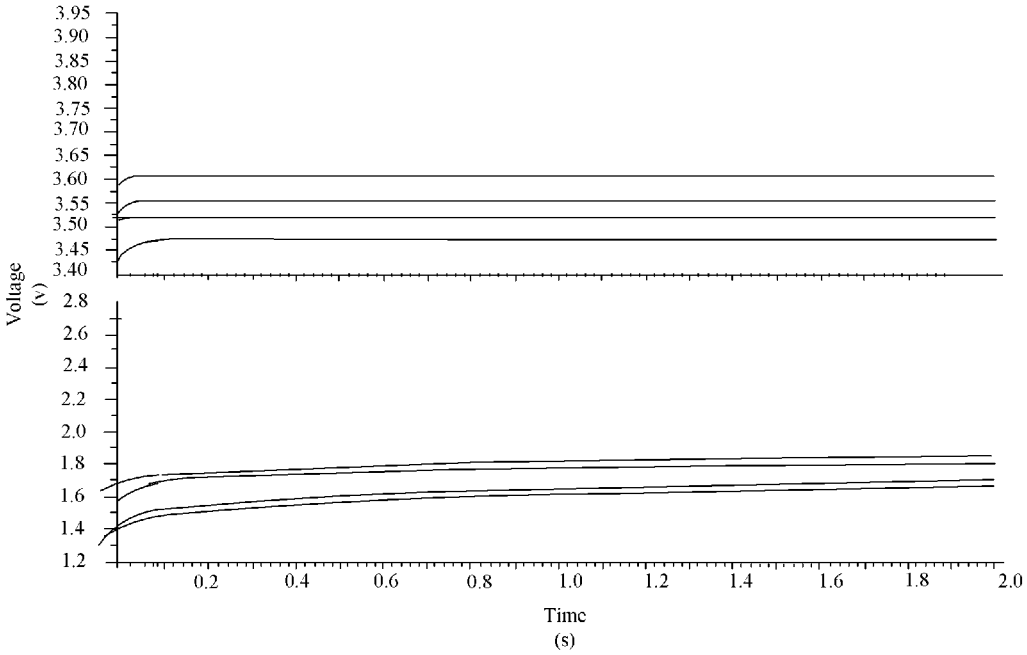
FIG. 4 illustrates the output voltages of an exemplary power supply regulator comprising a current regulator, for a range of load currents.

FIG. 4 illustrates the output voltages of an exemplary power supply comprising a current regulator, for a range of load currents. As with FIG. 1, the graphs are skewed worst case corner. The load current is increased linearly from 0 nA to 2 mA. The output voltage does not change more than 10 mV once the feedback stage is operational.

Figure 5:
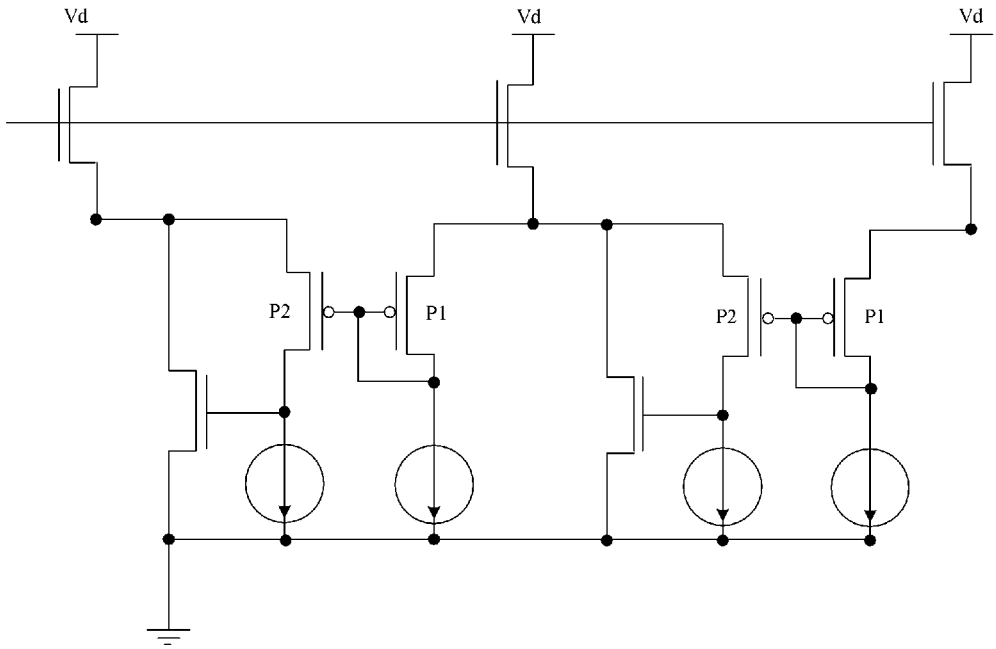
FIG. 5 illustrates the current regulator applied to multiple source follower circuits.

FIG. 5 illustrates the current regulator applied to multiple source follower circuits. Source follower circuits are often employed to isolate a source voltage from noisy analog signals, for example. The current regulator may be utilized in multiple source follower stages in a daisy chain, providing load regulation to each stage. Note that P1/P2 and the current sink values may vary from stage to stage.

Figure 6:
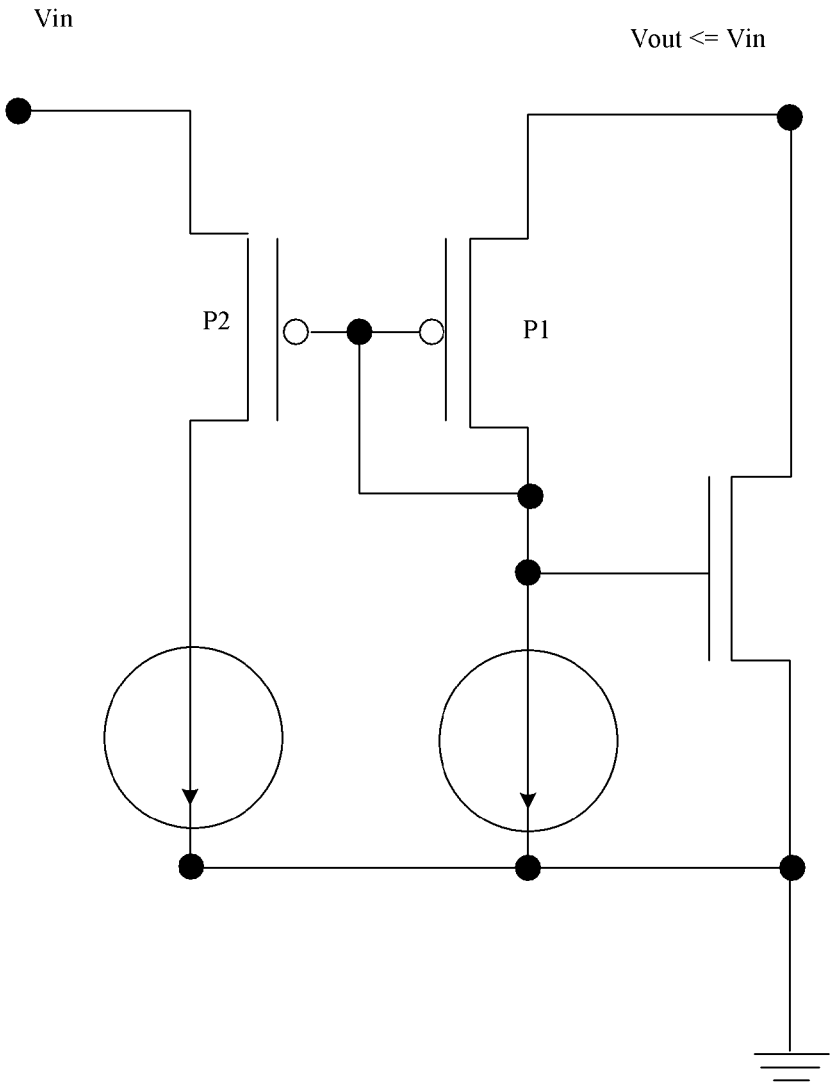
FIG. 6 illustrates an embodiment of a voltage protection circuit.

FIG. 6 illustrates an embodiment of a voltage protection circuit. The voltage protection circuit can be used to prevent a signal from going above or below a certain voltage. The two transistors P1 and P2, along with the current sinks, may be sized to limit the output voltage to a fraction of, or a multiple of, the input voltage.

Implementations and Alternatives

Those having skill in the art will appreciate that there are various logic implementations by which processes and/or systems described herein can be effected (e.g., hardware, software, and/or firmware), and that the preferred vehicle will vary with the context in which the processes are deployed. "Software" refers to logic that may be readily readapted to different purposes (e.g. read/write volatile or nonvolatile memory or media). "Firmware" refers to logic embodied as read-only memories and/or media. Hardware refers to logic embodied as analog and/or digital circuits. If an implementer determines that speed and accuracy are paramount, the implementer may opt for a hardware and/or firmware vehicle; alternatively, if flexibility is paramount, the implementer may opt for a solely software implementation; or, yet again alternatively, the implementer may opt for some combination of hardware, software, and/or firmware. Hence, there are several possible vehicles by which the processes described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations may involve optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood as notorious by those within the art that each function and/or operation within such block diagrams, flowcharts, or examples can be implemented, individually and/or collectively, by a wide range of hardware, software, firmware, or virtually any combination thereof. Several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory.

In a general sense, those skilled in the art will recognize that the various aspects described herein which can be implemented, individually and/or collectively, by a wide range of hardware, software, firmware, or any combination thereof can be viewed as being composed of various types of "circuitry." Consequently, as used herein "circuitry" includes, but is not limited to, electrical circuitry having at least one discrete electrical circuit, electrical circuitry having at least one integrated circuit, electrical circuitry having at least one application specific integrated circuit, circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), circuitry forming a memory device (e.g., forms of random access memory), and/or circuitry forming a communications device (e.g., a modem, communications switch, or optical-electrical equipment).

Those skilled in the art will recognize that it is common within the art to describe devices and/or processes in the fashion set forth herein, and thereafter use standard engineering practices to integrate such described devices and/or processes into larger systems. That is, at least a portion of the devices and/or processes described herein can be integrated into a network processing system via a reasonable amount of experimentation.

The foregoing described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

What is claimed is:

1. A power supply, comprising:

a source signal generating circuit;

an output stage;

a feedback stage;

a replica stage configured to replicate a response of the output stage to the source signal;

an output regulator coupling the replica stage to the output stage, configured to adjust a feedback signal to the source signal generating circuit by shunting the feedback stage to ground when a loaded output stage response does not match a response of the replica stage to the source signal.

2. The power supply of claim 1, further comprising:

the output regulator comprising a plurality of current regulated transistors at least two of which share a common gate terminal.

3. The power supply of claim 2, further comprising:

a transistor configured to shunt the feedback stage to ground.

4. The power supply of claim 3, further comprising:

a first PFET;

a second PFET; and the first and second PFETs sharing a common gate terminal, the common gate terminal grounded via a first current sink.

5. The power supply of claim 4, further comprising:

the second PFET driving the transistor that shunts the feedback stage; and the transistor that shunts the feedback stage regulated via a second current sink.

6. A regulator circuit, comprising:

a first transistor;

a second transistor replicating the first transistor;

an output regulator circuit coupling the first transistor to the second transistor, the regulator circuit comprising a plurality of current regulated transistors at least two of which share common gate terminal, wherein the common gate terminal grounded via a current sink.

7. The regulator circuit of claim 6, further comprising:

the output regulator comprising a third transistor configured to shunt the second transistor to ground.

8. The regulator of claim 7, further comprising:

a first of the at least two transistors that share a common gate terminal comprising a PFET driving the transistor that shunts the second transistor to ground; and a second of the at least two transistors that share a common gate terminal comprising a PFET grounded via a second current sink.

9. A method of generating regulated power for electronic circuits, comprising:

generating a source signal;

producing in an output stage an output power signal in response to the source signal;

replicating a response of the output stage to the source signal;

feeding a replicated response of the output stage to the source signal back to a circuit that generated the source signal; and reducing a proportion of the source signal fed back by shunting the replicated response to ground when the output stage response to the source signal does not match the replicated response to the source signal.

10. The method of claim 9, further comprising:

when the response of the output stage to the source signal does not match the replicated response of the output stage to the source signal, activating a plurality of current regulated transistors at least two of which share a common gate terminal.

* * * * *